US009176404B2

(12) United States Patent
Komada

(10) Patent No.: US 9,176,404 B2
(45) Date of Patent: Nov. 3, 2015

(54) METHOD FOR MANUFACTURING ELECTROSTATIC LATENT IMAGE DEVELOPING TONER

(71) Applicant: KYOCERA DOCUMENT SOLUTIONS INC., Osaka (JP)

(72) Inventor: Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 31 days.

(21) Appl. No.: 14/102,105

(22) Filed: Dec. 10, 2013

(65) Prior Publication Data

US 2014/0170559 A1 Jun. 19, 2014

(30) Foreign Application Priority Data

Dec. 13, 2012 (JP) ..... 2012-272691

(51) Int. Cl.
*G03G 9/08* (2006.01)
*G03G 9/087* (2006.01)

(52) U.S. Cl.
CPC ..... *G03G 9/081* (2013.01); *G03G 9/0804* (2013.01); *G03G 9/0812* (2013.01); *G03G 9/08755* (2013.01); *G03G 9/08795* (2013.01)

(58) Field of Classification Search
CPC ..... G03G 9/802; G03G 9/804; G03G 9/081
See application file for complete search history.

(56) References Cited

U.S. PATENT DOCUMENTS

| | | | |
|---|---|---|---|
| 2010/0316946 | A1 | 12/2010 | Faucher et al. |
| 2011/0104609 | A1 | 5/2011 | Qiu et al. |
| 2012/0148951 | A1 | 6/2012 | Qiu et al. |
| 2012/0189956 | A1* | 7/2012 | Chen et al. ..... 430/137.14 |

FOREIGN PATENT DOCUMENTS

| | | | |
|---|---|---|---|
| EP | 2264084 | A2 | 12/2010 |
| JP | 09-311502 | A | 12/1997 |
| JP | 2007-106906 | A | 4/2007 |
| JP | 2010-122687 | A | 6/2010 |
| JP | 2012-046617 | A | 3/2012 |

OTHER PUBLICATIONS

The extended European search report issued on Apr. 4, 2014, which corresponds to European Patent Application No. 13196382.9-1303 and is related to U.S. Appl. No. 14/102,105.

An Office Action; "Notice of Reasons for Rejection" issued by the Japanese Patent Office on Feb. 10, 2015, which corresponds to Japanese Patent Application No. 2012-272691 and is related to U.S. Appl. No. 14/102,105.

* cited by examiner

*Primary Examiner* — Peter Vajda
(74) *Attorney, Agent, or Firm* — Studebaker & Brackett PC

(57) ABSTRACT

Regarding a method for manufacturing an electrostatic latent image developing toner, which includes a process for aggregating particulates of components such as a binder resin, a colorant, and a releasing agent, a dispersion solution of binder resin particulates obtained by a specific method is used. The dispersion solution of the binder resin particulates are prepared as an oil-in-water emulsion containing particulates including the binder resin by mixing the binder resin, which is polyester resin, in a molten state with an organic base in a liquid state so as to neutralize the binder resin and subsequently mixing a resin molten solution with water. The amount of use of the organic base is 6 parts by mass or more with respect to 100 parts by mass of the binder resin. The degree of neutralization of the binder resin neutralized by the organic base is 100% or more.

7 Claims, 2 Drawing Sheets

METHOD FOR MANUFACTURING ELECTROSTATIC LATENT IMAGE DEVELOPING TONER

INCORPORATION BY REFERENCE

The present application claims priority under 35 U.S.C. §119 to Japanese Patent Application No. 2012-272691, filed Dec. 13, 2012. The contents of this application are incorporated herein by reference in their entirety.

BACKGROUND

The present application relates to methods for manufacturing an electrostatic latent image developing toner.

Regarding the electrostatic latent image developing toner, in recent years, it has been expected to reduce a particle diameter of toner particles to enhance resolution for better image quality. In order to output images of high quality, it is effective to make an average particle diameter of toner particles smaller to approximately 5 μm.

For the method of making the diameter of toner particles smaller, for example, it is possible to give a method for forming toner particles by emulsifying and dispersing, in a solvent, a component such as a resin and a pigment both of which are materials for the toner particles, and aggregating components such as the resin and the pigment that are materials for the toner particles. However, since an organic solvent and a large amount of surfactant are used in this method, there is a problem of causing a large amount of discharged water having a high chemical oxygen demand (COD) value and a high biochemical oxygen demand (BOD) value.

To solve such problems, suggested is a method of manufacturing, without using an organic solvent, a resin emulsified solution used for manufacturing the electrostatic latent image developing toner. In addition, a method of manufacturing toner without using an organic solvent is suggested for preparing an emulsified dispersion solution such as a resin or a pigment that is used for preparation of the toner particles.

SUMMARY

The present disclosure relates to a method for manufacturing an electrostatic latent image developing toner. The present disclosure includes:

(I) obtaining a resin molten solution including a binder resin by mixing an organic base in a liquid state and a binder resin in a molten state to neutralize the binder resin;

(II) obtaining an oil-in-water emulsion by mixing the resin molten solution with water, the oil-in-water emulsion containing particulates including the binder resin as an oil phase;

(III) obtaining a particulate mixture dispersion solution by mixing the oil-in-water emulsion with an aqueous dispersion solution including colorant particulates, an aqueous dispersion solution including releasing agent particulates, or an aqueous dispersion solution including the colorant particulates and the releasing agent particulates;

(IV) forming aggregated particles by adding an aggregating agent to the particulate mixture dispersion solution to aggregate the particulates in the particulate mixture dispersion solution; and (V) coalescing components included in the aggregated particles by maintaining the aggregated particles at a temperature within a range that is higher than a glass transition point (Tg) of the binder resin by 10° C. and is lower than a softening point (Tm) of the binder resin.

The binder resin is polyester resin, and the amount of use of the organic base is 6 parts by mass or more with respect to 100 parts by mass of the binder resin, and the degree of neutralization of the binder resin in the molten state in the obtaining a resin molten solution in (I) is 100% or more.

DETAILED DESCRIPTION

Figure 1:
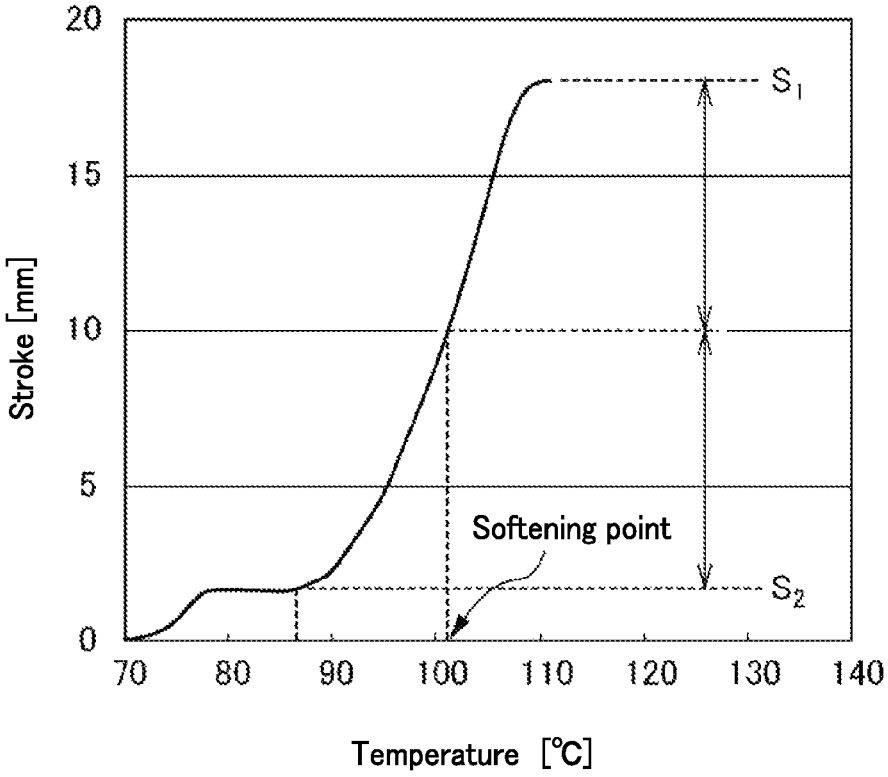
FIG. 1 is a diagram describing a method for measuring a softening point of polyester resin, using a flow tester.

The following describes embodiments of the present disclosure in detail. The present disclosure is not limited to the embodiments below in any case, and can be executed through appropriate alterations within the scope of the object of the present disclosure. It should be noted that for the points where descriptions are overlapped, there may be cases where the description is omitted where appropriate, which, however, does not limit the content of the disclosure.

The present disclosure is a method for manufacturing an electrostatic latent image developing toner including the following processes (I) to (V):

process (I) that is a process for obtaining a resin molten solution including a binder resin by mixing an organic base in a liquid state and the binder resin in a molten state to neutralize the binder resin;

process (II) that is a process for obtaining, an oil-in-water emulsion containing particulates including the binder resin, as an oil phase, by mixing the resin molten solution with water;

process (III) that is a process for obtaining a particulate mixture dispersion solution by mixing the oil-in-water emulsion with an aqueous dispersion solution including colorant particulates, an aqueous dispersion solution including releasing agent particulates, or an aqueous dispersion solution including the colorant particulates and the releasing agent particulates;

process (IV) that is a process for forming aggregated particles by adding an aggregating agent to the particulate mixture dispersion solution to aggregate the particulates in the particulate mixture dispersion solution; and process (V) that is a process for coalescing components included in the aggregated particles by maintaining the aggregated particles at a temperature within a range that is higher than a glass transition point (Tg) of the binder resin by 10° C. and is lower than a softening point (Tm) of the binder resin.

The binder resin used in the present disclosure is polyester resin. The amount of an organic base used in the process (I) above is 6 parts by mass or more with respect to 100 parts by mass of the binder resin. The degree of neutralization of the binder resin in the process (I) is 100% or more.

The following describes toner materials used in the method for manufacturing the electrostatic latent image developing toner and the method for manufacturing the electrostatic latent image developing toner according to the present disclosure.

<<Toner Material>>

The toner that is obtained using the method for manufacturing the electrostatic latent image developing toner (hereinafter, also referred to as the toner) according to the present disclosure includes an essential component such as the binder resin, and may also include an optional component such as a colorant, a releasing agent, and a charge control agent as necessary. In addition, the toner obtained by using the method for manufacturing the toner according to the present disclosure may be such that an external additive is attached to a surface of the toner particles as necessary. In addition, the toner that is obtained by using the method for manufacturing the toner according to the present disclosure can also be mixed with a desired carrier and used as a two component developer. The following describes: the binder resin that is an essential material for manufacturing the toner; a colorant, a releasing agent, a charge control agent, and an external additive that are optional materials; and a carrier to be used in the case of using the toner as the two component developer.

[Binder Resin]

In the method for manufacturing the electrostatic latent image developing toner according to the present disclosure, polyester resin is used as the binder resin. For polyester resin, a product obtained by condensation polymerization or copolycondensation of the alcohol component and the carboxylic acid component can be used. For components used for synthesizing the polyester resin, it is possible to use an alcohol component that is divalent, trivalent or more-valent or a carboxylic acid component that is divalent, trivalent or more-valent as below.

For specific examples of the alcohol component that is divalent, trivalent or more-valent, for example, it is possible to give: diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, or polytetramethylene glycol; bisphenols such as bisphenol A, hydrogenated bisphenol A, polyoxyethylene-modified bisphenol A, or polyoxypropylene-modified bisphenol A; or alcohols that is trivalent or more-valent such as sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, or 1,3,5-trihydroxymethylbenzene.

For specific examples of the carboxylic acid component that is divalent, trivalent or more-valent, for example, it is possible to give: divalent carboxylic acid such as maleic acid, fumaric acid, citraconic acid, itaconic acid, glutaconic acid, phthalic acid, isophthalic acid, terephthalic acid, cyclohexanedicarboxylic acid, succinic acid (alkylsuccinic acid or alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, or isododecenylsuccinic acid), adipic acid, sebacic acid, azelaic acid, and malonic acid; and carboxylic acid that is trivalent or more-valent such as 1,2,4-benzene tricarboxylic acid (trimellitic acid), 1,2,5-benzene tricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, or EMPOL trimer acid. These carboxylic acid components that is divalent, trivalent or more-valent may be formed as an ester-forming derivative such as acid halide, anhydride, or lower alkyl ester for use. Here, the "lower alkyl" refers to an alkyl group having 1 to 6 carbon atoms.

An acid value of the polyester resin should preferably be 10 mgKOH/g or more and 40 mgKOH/g or less. By setting the acid value of the polyester resin to the range as described above, the aggregation of the particulates of the polyester resin is likely to sufficiently progress in the process (IV) that is to be described later. If the acid value of the polyester resin is too low, it is difficult to form the oil-in-water emulsion in the process (II) that is to be described later. In addition, the acid value of the polyester resin can be adjusted by adjusting a balance between functional groups, that is, a hydroxyl group included in the alcohol component and a carboxylic group included in the carboxylic acid component, both of which are used for synthesizing the polyester resin.

The glass transition point (Tg) of the polyester resin should preferably be 38° C. or more and 68° C. or less, and more preferably be 40° C. or more and 60° C. or less. If the glass transition point (Tg) of the polyester resin is too low, the strength of the toner particles as a whole is likely low, and there may be cases where the toner particles become aggregated together under high-temperature high-humidity environment. On the other hand, if the glass transition point (Tg) of the polyester resin is too high, there may be cases where the toner is hard to be sufficiently fixed at low temperature.

The glass transition point (Tg) of the polyester resin can be obtained from a change point of specific heat, using a differential scanning calorimeter (DSC). For example, it is possible to measure an endothermic curve of the polyester resin, by using the differential scanning calorimeter ("DSC-6200" manufactured by Seiko Instruments Inc.) as a measurement device. By placing 10 mg of the polyester resin in an aluminum pan as a measurement sample and using an empty aluminum pan as a reference, the endothermic curve of the polyester resin is obtained by performing measurement on conditions: a measurement temperature range of 25° C. or more and 200° C. or less, and a heating rate of 10° C./min under normal temperature and normal humidity. From the obtained endothermic curve of the polyester resin, it is possible to obtain the glass transition point (Tg) of the polyester resin.

The softening point (Tm) of the polyester resin should preferably be 78° C. or more and 130° C. or less, and more preferably be 80° C. or more and 125° C. or less. By using the polyester resin having a softening point (Tm) within the range as described above as the binder resin of the toner, it is easy to obtain the toner that is excellent in low temperature fixability and is less likely to cause an offset at the time of fixing at high temperature. The softening point (Tm) of the polyester resin can be measured according to the method below.

<Softening Point Measurement Method>

The softening point (Tm) of the polyester resin is measured using an elevated type flow tester ("CFT-500D" manufactured by SHIMADZU CORPORATION). For example, the softening point (Tm) of the polyester resin is measured as follows. Using 1.5 g of the polyester resin as a measurement sample, a die having a height of 1.0 mm and a diameter of 1.0 mm is used. Then, the measurement is performed on conditions: a heating rate of 4° C./min, a pre-heat time of 300 seconds, a load of 5 kg, and a measurement temperature range of 60° C. or more and 200° C. or less. Using the flow tester, the softening point (Tm) of the polyester resin is read using the S-curve regarding the temperature (° C.) and a stroke (mm), which is obtained from measuring the softening point (Tm) of the polyester resin.

How to read the softening point (Tm) of the polyester resin is described using FIG. 1. A maximum value of the stroke is assumed as $S_1$, and a stroke value of a base line at a low temperature side is assumed as $S_2$. The temperature at which the value of the stroke is $(S_1+S_2)/2$ in the S-curve is assumed as the softening point (Tm) of the polyester resin.

The number average molecular weight (Mn) of the polyester resin should preferably be 1000 or more and 20000 or less. In addition, a molecular weight distribution (Mw/Mn) represented by a ratio between the number average molecular weight (Mn) and the weight average molecular weight (Mw) should preferably be 1 or more and 5 or less. By setting the molecular weight distribution (Mw/Mn) of the polyester resin to the range as described above, it becomes easier to suppress occurrence of an offset. In addition, it becomes easier to obtain a toner having a wide temperature range in which an offset does not occur. The number average molecular weight (Mn) and the weight average molecular weight (Mw) of the polyester resin can be measured using, for example, a gel permeation chromatography.

[Colorant]

For the colorant that may be included in the electrostatic latent image developing toner according to the present disclosure, it is possible to use a publicly-known pigment or dye according to the color of the toner particles. For a specific example of a preferred colorant that can be added to the toner, it is possible to give the following colorants.

For a black colorant, for example, carbon black can be given. In addition, for the black colorant, it is also possible to use a colorant that is toned, into black color, with a colorant such as a yellow colorant, a magenta colorant, or a cyan colorant that are to be described later. For the colorant for the color toner, for example, it is possible to give a colorant such as the yellow colorant, the magenta colorant, or the cyan colorant.

For the yellow colorant, for example, it is possible to give: a condensed azo compound, an isoindolinone compound, an anthraquinone compound, an azo-metallic complex, a methine compound, or an allylamide compound. Specifically, it is possible to give: C.I. pigment yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194.

For the magenta colorant, for example, it is possible to give: a condensed azo compound, a diketopyrrolopyrrole compound, an anthraquinone compound, a quinacridone compound, a basic dye lake compound, a naphthol compound, a benzimidazolone compound, a thioindigo compound, or a perylene compound. Specifically, it is possible to give: C.I. pigment red 2, 3, 5, 6, 7, 19, 23, 48:2, 48:3, 48:4, 57:1, 81:1, 122, 144, 146, 150, 166, 169, 177, 184, 185, 202, 206, 220, 221, or 254.

For the cyan colorant, for example, it is possible to give: a copper phthalocyanine compound, a copper phthalocyanine derivative, an anthraquinone compound, or a basic dye lake compound. Specifically, it is possible to give: C. I. pigment blue 1, 7, 15, 15:1, 15:2, 15:3, 15:4, 60, 62, or 66.

The colorant in each color can be used singly or by mixture. The amount of use of the colorant should preferably be 1% by mass or more and 30% by mass or less with respect to the mass of the toner.

[Releasing Agent]

The electrostatic latent image developing toner according to the present disclosure may include the releasing agent in order to enhance the low temperature fixability and offset resistance of the toner. The type of the releasing agent is not particularly limited as long as the releasing agent is used as the releasing agent for toner.

For the releasing agent, for example, it is possible to give: an aliphatic hydrocarbon-based wax such as low molecular weight polyethylene, low molecular weight polypropylene, a polyolefin copolymer, polyolefin wax, microcrystalline wax, paraffin wax, and/or Fischer-Tropsch wax; an oxide of aliphatic hydrocarbon-based wax such as polyethylene oxide wax, and/or a block copolymer of the polyethylene oxide wax; a vegetable wax such as candelilla wax, carnauba wax, Japan wax, jojoba wax, and rice wax; an animal wax such as beeswax, lanolin, and/or spermaceti; a mineral wax such as ozokerite, ceresine, and/or petrolatum; a wax having a fatty acid ester as a primary component such as montanoic acid ester wax and/or caster wax; and a wax formed by deoxidizing a part or all of fatty acid ester such as deoxidized carnauba wax.

The amount of use of the releasing agent should preferably be 3% by mass or more and 20% by mass or less with respect to the mass of the toner, and more preferably be 5% by mass or more and 15% by mass or less. If the amount of use of the releasing agent is too small, there may be cases where a desired effect cannot be obtained in suppressing the occurrence of an offset or suppressing the occurrence of image smearing at the time of image formation. On the other hand, if the amount of use of the releasing agent is too large, there may be cases where toner particles melt and stick together, thus causing a decrease in heat-resisting preservability of the toner.

[Charge Control Agent]

The electrostatic latent image developing toner according to the present disclosure may include a charge control agent as necessary. The charge control agent improves the charge level stability and charging startup characteristics of the toner. The charging startup characteristics serve as an index for whether or not it is possible to charge the toner to a predetermined charge level in a short time. Furthermore, the charge control agent is used for obtaining the toner having excellent durability and stability. In the case of positively charging the toner for performing development, a positively chargeable charge control agent is used. On the other hand, in the case of negatively charging the toner for performing development, a negatively chargeable charge control agent is used.

The type of the charge control agent can be appropriately selected from among charge control agents used for the toner. For the positively chargeable charge control agent, for example, it is possible to give: an azine compound such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, or quinoxaline; direct dyes made from an azine compound such as azine fast red FC, azine fast red 12BK, azine violet BO, azine brown 3G, azine light brown GR, azine dark green BH/C, azine deep black EW, or azine deep black 3RL; a nigrosine compound such as nigrosine, nigrosine salt, or a nigrosine derivative; an acid dye made from a nigrosine compound such as nigrosine BK, nigrosine NB, or nigrosine Z; metal salts of naphthenic acid or higher fatty acid; alkoxylated amine; alkylamide; and quaternary ammonium salt such as benzylmethylhexyldecylammonium or decyltrimethylammonium chloride. Among these positively chargeable charge control agents, the nigrosine compound is preferred for a reason of achieving quicker charging startup characteristics. For these positively chargeable charge control agents, one type may be used singly or two or more types can be used in combination.

Resin including quaternary ammonium salt, carboxylate salt, or a carboxyl group as a functional group can also be used as the positively chargeable charge control agent. For the positively chargeable charge control agent, for example, it is possible to give: styrene-based resin including quaternary ammonium salt, acrylic resin including quaternary ammonium salt, styrene-acrylic resin including quaternary ammonium salt, polyester resin including quaternary ammonium salt, styrene-based resin including carboxylate salt, acrylic resin including carboxylate salt, styrene-acrylic resin including carboxylate salt, polyester resin including carboxylate salt, styrene-based resin including a carboxyl group, acrylic resin including a carboxyl group, styrene-acrylic resin including a carboxyl group, or polyester resin including a carboxyl group. The molecular weight of these resins is not particularly limited within a range of not obstructing the object of the present disclosure, and may be an oligomer or a polymer.

For the negatively chargeable charge control agent, for example, it is possible to give an organometallic complex or a chelate compound. For the organometallic complex or the chelate compound, it is preferable to use a metal acetylacetonate complex such as aluminum acetylacetonate or iron(II) acetylacetonate, or a salicylic acid-based metal complex such as 3,5-di-tert-butylsalicylic acid chromium, or salicylic acid-based metal salt, and it is more preferable to use the salicylic acid-based metal complex or the salicylic acid-based metal salt. For these negative charge control agents, one type may be used singly or two or more types may be used in combination.

The amount of use of the positively or negatively chargeable charge control agent should preferably be 0.5 parts by mass or more and 15 parts by mass or less, with respect to 100 parts by mass of the total amount of toner, more preferably be 1.0 parts by mass or more and 8.0 parts by mass or less, and particularly preferably be 3.0 parts by mass or more and 7.0 parts by mass or less. If the amount of use of the charge control agent is too small, it is difficult to stably charge the toner to a predetermined polarity. Thus, there may be cases where the image density of the formed image is below a desired level or it becomes difficult to maintain the image density for a long time. In addition, in this case, it is difficult to uniformly disperse the charge control agent in the toner, thus making it more likely to cause fogging in the formed image or result in staining on a latent image bearing member due to attachment of a toner component. On the other hand, if the amount of use of the charge control agent is too large, it is likely to cause insufficient charge of the toner under high temperature and high humidity due to deterioration in environment resistance of the toner. In such case, problems such as image defect in the formed image or staining on the latent image bearing member due to attachment of the toner component are more likely to occur.

[External Additive]

In the electrostatic latent image developing toner that is obtained using the method according to the present disclosure, an external additive may be attached to the surface of the toner particles as necessary. The types of the external additive can be appropriately selected from among external additives for toner. For the external additives, for example, it is possible to give: silica, or metal oxide such as alumina, titanium oxide, magnesium oxide, zinc oxide, strontium titanate, or barium titanate. For these external additives, one type may be used singly or two or more types may be used in combination.

The external additives as described above can also be hydrophobized for use, using a hydrophobizing agent such as an aminosilane coupling agent or silicone oil. In the case of using a hydrophobized external additive, it is possible to suppress decrease in the charge amount of the toner under high temperature and high humidity as well as allowing sufficient fluidity of the toner.

A particle diameter of the external additive should preferably be 0.01 μm or more and 1.0 μm or less.

The amount of use of the external additive should preferably be 0.1 parts by mass or more and 10 parts by mass or less with respect to 100 parts by mass of toner particles before treatment with the external additive, and more preferably be 0.2 parts by mass or more and 5 parts by mass or less.

[Carrier]

The electrostatic latent image developing toner that is obtained using the method according to the present disclosure can also be mixed with a desired carrier and used as a two component developer. For preparing the two component developer, it is preferable to use a magnetic carrier.

For a preferred carrier in the case of using the electrostatic latent image developing toner as the two component developer, it is possible to give a carrier having a carrier core coated with resin. For the carrier core, for example, it is possible to give: particles of metal such as iron, oxidatively-treated iron, reduced iron, magnetite, copper, silicon steel, ferrite, nickel, or cobalt; particles of an alloy made from these materials and metal such as manganese, zinc, or aluminum; particles of an iron alloy such as a nickel-iron alloy or a cobalt-iron alloy; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; particles of a high-permittivity substance such as ammonium dihydrogen phosphate, potassium dihydrogen phosphate, or Rochelle salt; and a resin carrier core formed by dispersing the above magnetic powder in resin.

For the resin for coating the carrier core, for example, it is possible to give: a (meth)acrylic polymer, a styrene-based polymer, a styrene-(meth)acrylic copolymer, an olefin-based polymer (polyethylene, chlorinated polyethylene, or polypropylene), polyvinyl chloride, polyvinyl acetate, polycarbonate, cellulose resin, polyester resin, unsaturated polyester resin, polyamide resin, polyurethane resin, epoxy resin, silicone resin, fluororesin (polytetrafluoroethylene, polychlorotrifluoroethylene, or polyvinylidene fluoride), phenol resin, xylene resin, diallyl phthalate resin, polyacetal resin, or amino resin. For these resins, one type may be used singly or two or more types may be used in combination.

A particle diameter of the carrier should preferably be 20 μm or more and 120 μm or less, and more preferably be 25 μm or more and 80 μm or less. It should be noted that the particle diameter of the carrier is measured using an electron microscope.

In the case of using, as the two component developer, the toner that is manufactured using the method according to the present disclosure, a content of the toner in the two component developer should preferably be 3% by mass or more and 20% by mass or less, with respect to the mass of the two component developer, and more preferably be 5% by mass or more and 15% by mass or less. By setting the toner content in the two component developer to the range as described above, it is easy to maintain the image density of the formed image at an appropriate level. In addition, this suppresses scattering of the toner from the developing device, thus allowing suppressing staining inside the image forming apparatus caused by a toner component or attachment of the toner to transfer paper.

Using the material as described above, the electrostatic latent image developing toner is prepared according to the method as described below.

<<Method for Manufacturing the Electrostatic Latent Image Developing Toner>>

The method for manufacturing the electrostatic latent image developing toner according to the present disclosure includes at least the following processes (I) to (V):

process (I) that is a process for obtaining a resin molten solution including a binder resin by mixing an organic base in a liquid state and a binder resin in a molten state to neutralize the binder resin;

process (II) that is a process for obtaining an oil-in-water emulsion containing particulates including the binder resin as an oil phase, by mixing the resin molten solution with water;

process (III) that is a process for obtaining a particulate mixture dispersion solution by mixing the oil-in-water emulsion with an aqueous dispersion solution including colorant particulates, an aqueous dispersion solution including releasing agent particulates, or an aqueous dispersion solution including the colorant particulates and the releasing agent particulates;

process (IV) that is a process for forming aggregated particles by adding an aggregating agent to the particulate mixture dispersion solution to aggregate the particulates in the particulate mixture dispersion solution; and process (V) that is a process for coalescing components included in the aggregated particles by maintaining the aggregated particles at a temperature within a range that is higher than a glass transition point (Tg) of the binder resin by 10° C. and is lower than a softening point (Tm) of the binder resin.

For the binder resin, polyester resin is used. The amount of use of the organic base in the process (I) is 6 parts by mass or more with respect to 100 parts by mass of the binder resin. The degree of neutralization of the binder resin in the molten state is 100% or more. Furthermore, the degree of neutralization of the binder resin in the process (I) should preferably be 300% or less.

The method for manufacturing the electrostatic latent image developing toner according to the present disclosure may include the following processes (VI) to (VIII) in addition to the processes (I) to (V) as described above:

process (VI) that is a washing process for cleaning the coalesced particles obtained in process (V);

process (VII) that is a drying process for drying the coalesced particles obtained in process (V); and process (VIII) that is an external addition process for attaching the external additive to the surface of the toner base particles.

The processes (I) to (VIII) will be described below.

[Process (I)]

In the process (I), by mixing an organic base in a liquid state and a binder resin in a molten state for neutralizing the binder resin, a resin molten solution including the binder resin is obtained. For the method for preparing the resin molten solution, it is possible to give: a method for obtaining the resin molten solution by mixing the organic base and the binder resin and subsequently heating the mixture to a temperature higher than the melting point of the binder resin; and a method for obtaining the resin molten solution by melting the binder resin by heating the binder resin to a temperature higher than the melting point of the binder resin for neutralizing the binder resin in the molten state using the organic base.

For the method for preparing the resin molten solution, a method including the following processes (i) and (ii) is preferable:

process (i) that is a process for obtaining a molten solution including the binder resin by heating the binder resin to a temperature higher than the softening point (Tm) of the binder resin for melting the binder resin; and process (ii) that is a process for obtaining a resin molten solution including the neutralized binder resin by mixing a molten solution and an organic base while maintaining the resin molten solution at a temperature higher than the softening point (Tm) of the binder resin.

With the method for obtaining the resin molten solution by mixing the binder resin with the organic base and subsequently heating the mixture to the temperature higher than the melting point of the binder resin, there may be cases where when heating the binder resin, unevenness may occur in density of the organic base in the binder resin. If the mixture of the binder resin and the organic base is heated in a state where the density of the organic base is uneven, there may be cases where heat deterioration of the binder resin occurs and where hydrolysis of the binder resin occurs due to moisture in the air. According to a method including processes (i) and (ii) above, it is possible to quickly prepare the resin molten solution including the binder resin neutralized by the organic base, while suppressing occurrence of problems such as the heat deterioration of the binder resin and hydrolysis of the binder resin due to moisture in the air.

Processes (i) and (ii) will be described below.

(Process (i))

In the process (i), the binder resin is heated to a temperature higher than the softening point (Tm) of the binder resin, to melt the binder resin. The temperature for melting the binder resin is not particularly limited, but should preferably be: the softening point (Tm) of the binder resin+10° C. or more and the softening point (Tm) of the binder resin+30° C. or less.

(Process (ii))

In the process (ii), a molten solution is mixed with an organic base in the liquid state while maintaining the resin molten solution at a temperature higher than the softening point (Tm) of the binder resin, to obtain the resin molten solution including the binder resin neutralized by the organic base. For a kneader mixer used for mixing the binder resin in the molten state and the organic base in the liquid state, for example, it is possible to give HIVIS DISPER MIX (PRIMIX Corporation) and PLANETARY DESPA (ASADA Iron Works Co., Ltd.). In addition, since the kneader mixer can easily maintain the molten state of the binder resin, it is preferable that it includes a jacket that allows temperature adjustment be included.

In the method for manufacturing the toner according to the present disclosure, the organic base is used for neutralizing the polyester resin that is the binder resin. The organic base is in the liquid state and is to be mixed with the binder resin in the molten state, but need not be mixed with the binder resin as a liquid. For example, the method for neutralizing the binder resin in the process (I) includes a method of neutralizing the binder resin by adding, to the molten solution of the binder resin, the organic base that is a solid at room temperature and is a liquid at the softening point (Tm) of the binder resin.

In the method for manufacturing the toner according to the present disclosure, the organic base does not substantially include water. Therefore, even when it is necessary to heat the binder resin to 100° C. or more for neutralizing the binder resin, it is possible to neutralize the binder resin without using an expensive pressure-proof apparatus. In addition, since the organic base contains substantially no water, with the method for manufacturing the toner according to the present disclosure, the hydrolysis of the polyester resin, which is the binder resin, at the time of neutralizing the binder resin is suppressed.

It should be noted that the organic base need not be completely absolute, and it is also possible to use an organic base including a slight amount of moisture due to effects of moisture absorption and unavoidable water incorporation. A permissible content of water in the organic base should preferably be 10% by mass or less, more preferably be 5% by mass or less, and particularly preferably be 3% by mass or less.

The amount of use of the organic base is 6 parts by mass or more with respect to 100 parts by mass of the binder resin. The organic base is used at an amount such that the degree of neutralization of the binder resin in the molten state, which is obtained in the process (I), is 100% or more. Furthermore, it is preferable that the amount of use be such that the degree of neutralization of the binder resin in the molten state, which is obtained in the process (I), be 300% or less. With the amount of use of the organic base, the binder resin in the molten state is likely to be plasticized. Therefore, in the process (I), even when decreasing, after mixing the organic base with the binder resin in the molten state, the temperature of the obtained mixture within a range of 15° C. or more and 30° C. or less, it is possible to quickly progress the neutralization of the binder resin without causing extreme thickening of the mixture. Thus, the neutralization of the binder resin in the method for manufacturing the toner according to the present disclosure can be performed at low temperature and in a short time. The degree of neutralization can be represented by the formula below.

Degree of neutralization (%)=100−(mole number of an acid radical before neutralization−mole number of the organic base)×100)

The type of the organic base used for neutralizing the binder resin is not particularly limited, and is normally a basic nitrogen-containing compound. For the basic nitrogen-containing compound, for example, it is possible to use a compound such as acyclic amine, cyclic amine, and/or an aromatic heterocyclic compound. The organic base is not limited to a monovalent base, but may be a polyvalent organic base that is divalent or more-valent. When mixing with the binder resin in the molten state, as the organic base that is in the liquid state or is quickly melting, for example, it is possible to give: N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, or vinylpyridine. In addition, for these organic bases, one type may be used singly, or two or more types may be used in combination.

In addition, a boiling point of the organic base should preferably be 100° C. or more, more preferably be 125° C. or more, and particularly preferably be 150° C. or more. By using the organic base having the boiling point as above, it is possible to suppress loss of the organic base due to volatilization when neutralizing the binder resin under atmospheric pressure.

The resin molten solution can include a surfactant. By including the surfactant in the resin molten solution, it is possible to form an oil-in-water emulsion having excellent dispersion stability in the process (II) to be described later.

The surfactant to be mixed with the resin molten solution is not particularly limited. For the surfactant, for example, it is possible to appropriately select from a group consisting of anionic surfactants, and/or nonionic surfactants. For the anionic surfactant, for example, it is possible to give: sulfate ester type surfactant, sulfonate type surfactant, phosphate ester type surfactant, and/or soap. For the nonionic surfactant, for example, it is possible to give a polyethylene glycol type surfactant, an alkylphenolethyleneoxide-addition type surfactant, or a polyvalent alcohol type surfactant that is a derivative of polyvalent alcohol such as glycerin, sorbitol, or sorbitan. Among these surfactants, it is preferable to use at least one of the anionic surfactant and the nonionic surfactant. For these surfactants, one type may be used singly, or two or more types may be used in combination.

The amount of use of the surfactant should preferably be such that the density of the surfactant in the oil-in-water emulsion formed in the process (II) to be described below is 0.5% by mass or more and 5% by mass or less.

[Process (II)]

In the process (II), the resin molten solution and water are mixed, to obtain the oil-in-water emulsion containing, as an oil phase, particulates including the binder resin. When mixing the resin molten solution with water, in order to avoid rapid change in the temperature of the resin molten solution, it is preferable that a difference between water temperature and the temperature of the resin molten solution (water temperature−temperature of the resin molten solution) be −20° C. or more and 5° C. or less.

In the process (II), when forming the oil-in-water emulsion, it is possible to use the surfactant as necessary. In the process (II), the type and amount of the surfactant usable in the process (II) is the same as the type and amount of the surfactant described in the process (I). In addition, it is possible to appropriately select water from among clean water, industrial water, distilled water, or ion-exchange water. The amount of water with respect to the resin molten solution obtained in process the (I) should preferably be 2.5 times by mass or more and 20 times by mass or less with respect to the mass of the resin molten solution prepared in the process (I).

[Process (III)]

In the process (III), the oil-in-water emulsion is mixed with an aqueous dispersion solution including colorant particulates, an aqueous dispersion solution including releasing agent particulates, or an aqueous dispersion solution including the colorant particulates and the releasing agent particulates, to obtain particulate mixture dispersion solution. The following describes a method for preparing the aqueous dispersion solution including colorant particulates and aqueous dispersion solution including releasing agent particulates. It should be noted that the aqueous dispersion solution including the colorant particulates and the releasing agent particulates can be prepared by mixing the aqueous dispersion solution including the colorant particulates and the aqueous dispersion solution including the releasing agent particulates at a desired ratio and adjusting the solid concentration as necessary.

[Preparing the Aqueous Dispersion Solution Including Colorant Particulates]

The method for preparing the aqueous dispersion solution including the colorant particulates is not particularly limited, but it is possible to obtain particulates including the colorant by performing dispersion treatment, in the aqueous dispersion solution including the surfactant, on the colorant using a publicly known disperser and, as necessary, a component such as a dispersion agent for the colorant. The type of the surfactant is not particularly limited. For the surfactant, for example, it is possible to give an anionic surfactant, a cationic surfactant, and/or a nonionic surfactant. The amount of use of the surfactant is not particularly limited, but should preferably be at a critical micelle concentration (CMC) or more.

The disperser used for the dispersion treatment is not particularly limited. For the disperser, for example, it is possible to use: an ultrasonic disperser; a pressure disperser such as a mechanical homogenizer, a Manton-Gaulin, or a pressure homogenizer; or a medium-type disperser such as a sand grinder, a Getzmann mill, or a diamond fine mill.

In addition, when the colorant dispersed in the aqueous dispersion solution including the colorant particulates is a pigment, it is preferable to prepare the aqueous dispersion solution including the colorant particulates by using a microreactor. In the case of preparing the aqueous dispersion solution including pigment particulates using the microreactor, the pigment particulates are precipitated by mixing a first pigment stock solution supplied from a first stock solution supply section and a second pigment stock solution supplied from a second stock solution supply section in the microreactor. The following describes, with reference to FIG. 2, the microreactor and the preparation of the aqueous dispersion solution including the pigment particulates using the microreactor.

<Microreactor>

Figure 2:
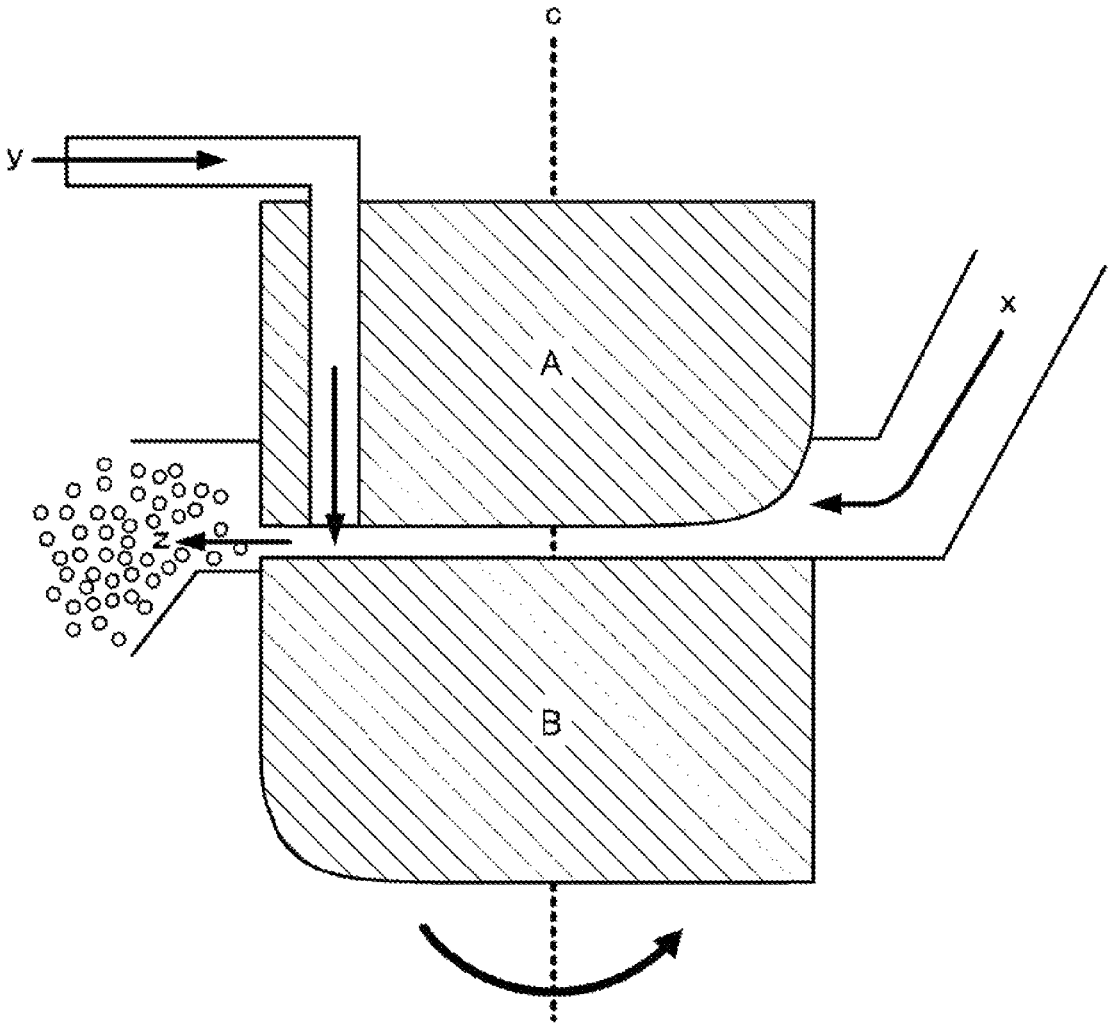
FIG. 2 is a cross-sectional view of a microreactor used for preparing a pigment particulate dispersion solution.

FIG. 2 is a cross-sectional view of a microreactor used for preparing the aqueous dispersion solution including pigment particulates. As shown in FIG. 2, the microreactor includes two plate-shaped discs, that is, a fixed disc A and a rotation disc B. The fixed disc A and the rotation disc B are disposed such that a gap having a height of 1 μm or more and 100 μm or less is formed between the fixed disc A and the rotation disc B.

In the microreactor shown in FIG. 2, the first pigment stock solution that is a pigment particulate dispersion solution from a first stock solution supply section x and the second pigment stock solution including an aggregating agent from a second stock solution supply section y are supplied, respectively, from a first stock solution supply section x and a second stock solution supply section y. By supplying the first stock solution and the second stock solution, pigment particulates are manufactured in the gap formed between the fixed disc A and the rotation disc B. The pigment particulates thus manufactured is ejected from a solution ejection section z as the pigment particulate dispersion solution.

In the microreactor shown in FIG. 2, the fixed disc A has a floating structure that is movable in a direction parallel to a rotation axis c of the rotation disc B and the rotation disc B are used. Due to the structure as above, the height of the gap formed between the fixed disc A and the rotation disc B is adjusted by changing a pressure that is generated by an inflow of the first pigment stock solution supplied from the first stock solution supply section and that works in a direction for pushing up the fixed disc A (an upward direction in FIG. 2), and a pressure that is given by the own weight of the fixed disc A as well as in a direction for pushing down the fixed disc A (a downward direction in FIG. 2). In other words, the height of the gap formed between the fixed disc A and the rotation disc B is adjusted by adjusting a flow amount of the first pigment stock solution, a mass of the fixed disc A, and/or a back pressure given from an upper side of the fixed disc A. For the pressure given to the fixed disc A from the upper side, it is possible to give the back pressure using gas.

Materials for the fixed disc A and the rotation disc B are not particularly limited as long as the material is less likely to cause corrosion due to the first and the second stock solutions and has sufficient strength. For the materials for the fixed disc A and the rotation disc B, for example, it is possible to give carbon and silicon carbide. In addition, for materials having excellent chemical resistance, for example, it is possible to give hastelloy, glass, ceramic, or fluororesin.

It is preferable to adjust the height of the gap formed between the fixed disc A and the rotation disc B according to the type of the first pigment stock solution, the second pigment stock solution, and the pigment particulates to be precipitated. In the case of preparing the aqueous dispersion solution including the pigment particulates, the height of the gap should preferably be 1 μm or more and 50 μm or less, and more preferably be 1 μm or more and 10 μm or less.

The rotation disc B rotates around the rotation axis c passing through the centers of the fixed disc A and the rotation disc B. In the case of preparing the aqueous dispersion solution including pigment particulates, a rotation rate of the rotation disc B should preferably be 200 rpm or more and 4000 rpm or less, and more preferably be 300 rpm or more and 3600 rpm or less.

For the number of the second stock solution supply sections y provided in the fixed disc A, one or a plurality of the second stock solution supply sections y may be provided. In the case of providing a plurality of the second stock solution supply sections y, for the type of the second pigment stock solution to be supplied from the second stock solution section, one or a plurality of types may be supplied. The shape of the second stock solution supply section y is appropriately designed by taking the supply amount of the second pigment stock solution into consideration.

For the microreactor including the above configuration, for example, it is possible to give a forced thin film reactor ("ULREA SS-11" manufactured by M TECHNIQUE Co., Ltd.). The following describes preparation of the pigment particulate dispersion solution including pigment particulates using the microreactor.

<Preparing the Aqueous Dispersion Solution Including Pigment Particulates Using the Microreactor>

For preparing the aqueous dispersion solution including pigment particulates by using the microreactor, as shown in FIG. 2, the first pigment stock solution is supplied from the first stock solution supply section x, so as to fill the gap formed between the fixed disc A and the rotation disc B with the first pigment stock solution, to form a thin film fluid. Next, to the thin film fluid of the first pigment stock solution, the second pigment stock solution is supplied from the second stock solution supply section y as shown in FIG. 2, so as to mix the first pigment stock solution and the second pigment stock solution in the gap formed between the fixed disc A and the rotation disc B, to precipitate pigment particulates. The pigment particulates obtained by the precipitation are collected at the solution ejection section z as the aqueous dispersion solution including the pigment particulates.

For the first pigment stock solution used for preparing the aqueous dispersion solution including the pigment particulates, a pigment solution formed by dissolving a pigment in a solvent is used. The solvent in which the pigment is dissolved is not particularly limited as long as the solvent dissolves the pigment sufficiently. For the solvent in which the pigment is to be dissolved, for example, it is possible to give an organic solvent, or an acid aqueous solution. For the acid to be included in the acid aqueous solution, for example, it is preferable to use sulfuric acid, hydrochloric acid, nitric acid, or trifluoroacetic acid, and it is more preferable to use strong acid such as concentrated sulfuric acid having a concentration of 95% by mass or more.

The second pigment stock solution used for preparing the aqueous dispersion solution including pigment particulates is not particularly limited, and water or alkaline aqueous solution is preferable. For the alkaline aqueous solution, for example, it is possible to give ammonia water, aqueous sodium hydroxide solution, and/or aqueous potassium hydroxide solution.

As described above, for the method of preparing the aqueous dispersion solution including pigment particulates, the acid pasting method is preferable. In the acid pasting method, the pigment particulates are precipitated by mixing the acid aqueous solution of the pigment (the first pigment stock solution) with water or an alkaline aqueous solution (the second pigment stock solution).

For methods other than the acid pasting method, another preferable method is to precipitate the pigment by mixing the first pigment stock solution and the second pigment stock solution, using an organic solvent solution of the pigment as the second pigment stock solution and using a poor solvent of the pigment as the first pigment stock solution. For the organic solvent included in the first pigment stock solution, for example, it is possible to give an aprotic polar organic solvent such as N-methyl-2-pyrrolidone, dimethylformamide, dimethylacetamide, dimethylsulfoxide, and sulfolane. For the poor solvent used as the second pigment stock solution, for example, it is possible to give: water, methanol, ethanol, methanol aqueous solution, or ethanol aqueous solution.

To control the type or the size of crystals when precipitating the pigment, the first pigment stock solution and the second pigment stock solution as described above may be mixed with a publicly known organic solvent, high molecular compound, or surfactant.

It is preferable that the aqueous dispersion solution including the pigment particulates and the alkaline aqueous solution (for example, sodium hydroxide) be mixed at the solution ejection section z where the aqueous dispersion solution including the pigment particulates is collected. By performing such treatment, it is possible to hydrophilize the surface of the pigment particulates. The pigment particulates thus hydrophilized can be sufficiently dispersed using the surfactant. Therefore, by hydrophilizing the pigment particulates, it becomes easier to obtain the aqueous dispersion solution including the pigment particulates having excellent dispersion stability.

The supply amount of the first pigment stock solution varies according to the shape of the microreactor, but should preferably be 100 ml/minute or more and 1000 ml/minute or less. The supply amount of the second pigment stock solution varies according to the supply amount of the first pigment stock solution, but should preferably be 1 ml/minute or more and 500 ml/minute or less. The temperature of the first pigment stock solution and the second pigment stock solution, at the time of supplying the first pigment stock solution and the second pigment stock, solution differs according to the pigment stock solution to be used, but normally should preferably be 0° C. or more and 50° C. or less.

By increasing the back pressure given from the upper side of the fixed disc A, increasing the rotation rate of the rotation disc B, or decreasing the supply amount of the second pigment stock solution, it is possible to decrease a Cv value of the pigment particulates.

Described above has been the method for obtaining the aqueous dispersion solution including pigment particulates by mixing the first pigment stock solution and the second pigment stock solution for precipitating the pigment particulates, using a microreactor. The aqueous dispersion solution including pigment particulates may also be obtained using the method of mixing a plurality kinds of pigment stock solutions including a synthetic material for the pigment and precipitating the generated pigment as particulates by chemical reaction of the pigment stock solutions. For such a method, for example, it is possible to give a method of mixing a pigment stock solution including diazonium salt and a pigment stock solution including a coupler for precipitating the particulates of an azo pigment in the microreactor.

An average primary particle diameter and the Cv value of the pigment particulates can be obtained by measuring a particle size distribution of the pigment particulates. The particle size distribution of the pigment particulates can be measured using a particle size distribution measuring apparatus ("Microtrac UPA 150" manufactured by Nikkiso Co., Ltd.). In addition, an average degree of circularity of the pigment particulates can be obtained from a TEM image of the pigment particulates.

[Aqueous Dispersion Solution Including Releasing Agent Particulates]

The releasing agent is coarsely pulverized down to an average particle diameter of approximately 100 μm or less. The product from coarsely pulverizing the releasing agent is added to an aqueous medium including the surfactant. The slurry is heated to a temperature equal to or higher than the melting point of the releasing agent. The heated slurry is provided with a strong shearing force using a homogenizer or a pressure discharge type disperser, to prepare the aqueous dispersion solution including releasing agent particulates.

For the apparatus with which to give a strong shearing force to the dispersion solution, for example, it is possible to give: NANO3000 (manufactured by Beryu Co., Ltd.), Nanomizer (manufactured by YOSHIDA KIKAI CO., LTD.), Microfluidizer (manufactured by MFI Corporation), Gaulin homogenizer (manufactured by Manton Gaulin), or CLEARMIX W-MOTION (manufactured by M Technique Co., Ltd.).

[Process (IV)]

In the process (IV), an aggregating agent is added to the particulate mixture dispersion solution so as to aggregate the particulates in the particulate mixture dispersion solution, to form aggregated particles. The following describes the aggregating agent and formation of aggregated particles.

[Aggregating Agent]

For the aggregating agent that can be added to the particulate mixture dispersion solution, for example, it is possible to give: inorganic metal salt, inorganic ammonium salt, and a metal complex that is divalent or more-valent. For the inorganic metal salt, for example, metal salt such as sodium sulfate, sodium chloride, calcium chloride, calcium nitrate, barium chloride, magnesium chloride, zinc chloride, aluminum chloride, or aluminum sulfate; or an inorganic metal salt polymer such as polyaluminum chloride and polyaluminum hydroxide. For the inorganic ammonium salt, for example, it is possible to give: ammonium sulfate, ammonium chloride, and ammonium nitrate. In addition, a cationic surfactant of quarternary ammonium salt type and polyethyleneimine can be used as the aggregating agent.

For the aggregating agent, for example, divalent metal salt and monovalent metal salt are preferably used. It is more preferable that the divalent metal salt and the monovalent metal salt be used in combination. Since an aggregation rate of particulates by the divalent metal salt and the aggregation rate of particulates by the monovalent metal salt are different, using these in combination makes it easier to control the particle diameter of the aggregated particles to be obtained as well as narrowing the particle size distribution of the particulates.

An additive amount of the aggregating agent should preferably be 0.1 mmol/g or more and 10 mmol/g or less, with respect to a solid content of the particulate mixture dispersion solution. In addition, the additive amount of the aggregating agent should preferably be adjusted appropriately according to the type and the amount of the surfactant included in the oil-in-water emulsion.

[Forming Aggregated Particles]

After adding the aggregating agent to the particulate mixture dispersion solution, it is preferable to maintain the particulate mixture dispersion solution at a temperature that is equal to or higher than the glass transition point (Tg) of the binder resin and is equal to or lower than a temperature higher than the glass transition point (Tg) of the binder resin by 15° C. By maintaining the particulate mixture dispersion solution at the temperature within the range as described above, it is possible to uniformly disperse the optional component such as the releasing agent, and the colorant in the aggregated particles, and to make it easier to control the aggregated particles to be obtained in a desired particle shape.

In addition, after adding the aggregating agent to the particulate mixture dispersion solution, it is preferable to add the surfactant so as to suppress the aggregation rate of the particulates. For the surfactant that can be used for suppressing the aggregation rate of the particulates, for example, it is possible to use a surfactant similar to the surfactant that can be used for preparing the resin molten solution as described above. The additive amount of the surfactant should preferably be 5% by mass or more and 20% by mass or less, with respect to the total mass of the component used as the materials for the toner.

After the aggregation progresses until the aggregated particles have a desired particle diameter, an aggregation terminator is added so as to stop the progress of the aggregation. For the aggregation terminator, for example, it is possible to give: sodium chloride, potassium chloride, magnesium chloride, or sodium hydroxide. In the aggregation process as above, it is possible to obtain the aqueous dispersion solution including aggregated particles.

[Process (V)]

In the process (V), aggregated particles are heated at a temperature within a range that is higher than the glass transition point (Tg) of the binder resin by 10° C. and is lower than the softening point (Tm) of the binder resin. By heating the aggregated particles to a temperature within the range as described above, it is possible to sufficiently progress the coalescing of the components included in the aggregated particles as well as facilitating preparation of the toner having a preferred sphericity.

By heating the aggregated particles, the shape of the aggregated particles is gradually approaching a spherical shape. By controlling the temperature for heating the aggregated particles and the heating time, it is possible to control the sphericity of the aggregated particles at a desired value. This is because along with an increase in temperature when heating the aggregated particles, the melt viscosity of the binder resin decreases, and a shape change is caused in the direction of spheronization by surface tension in the binder resin.

[Process (VI)]

The coalesced particles obtained in the process (V), which are toner particles or toner base particles, are washed with water as necessary. The washing method is not particularly limited, and by performing solid-liquid separation from the dispersion solution of the coalesced particles, the coalesced particles are collected as wet cake. It is possible to give a method of cleaning the obtained wet cake with water, or a method of depositing the coalesced particles in the dispersion solution of the coalesced particles, replacing a supernatant liquid with water, and re-dispersing the coalesced particles in water after the replacement.

[Process (VII)]

The coalesced particles obtained in the process (V) are dried as necessary. The method of drying the coalesced particles is not particularly limited. For the dryer used for the drying method, for example, it is possible to give: a spray dryer, a fluidized bed dryer, a vacuum freeze dryer, or a vacuum dryer. Among the dryers as described above, the spray dryer is preferable for a reason of making it easy to suppress aggregation of the coalesced particles during drying. In the case of using the spray dryer, by spraying the dispersion solution of the coalesced particles and a dispersion solution of the external additive such as silica, it is possible to obtain toner particles having the external additive on the surface of the toner base particles as described above. The coalesced particles that have been dried may be assumed as toner particles or as toner base particles to be treated by external addition treatment in the process (VIII).

[Process (VIII)]

In the process (VIII), the external additive is attached to the surface of the toner base particles. The method for attaching the external additive to the surface of the toner base particles is not particularly limited. For the method for attaching the external additive to the surface of the toner base particles, for example, it is possible to give a method of mixing by adjusting conditions such that the external additive is not embedded in the surface of the toner base particles, using a mixer such as a Henschel Mixer or a Nauta mixer.

According to the disclosure as described above, it is possible to provide the method for manufacturing the electrostatic latent image developing toner. The method for manufacturing the electrostatic latent image developing toner according to the present disclosure includes a process for preparing the dispersion solution containing particulates including the binder resin by neutralizing the binder resin at low temperature and in a short time. Thus, according to the method for manufacturing the toner according to the present disclosure, it is possible to reduce the consumption amount of energy required for manufacturing the toner.

EXAMPLES

The following describes the present disclosure further specifically using examples. It should be noted that the present disclosure is not to be limited in any case by the scope of the examples.

Preparation Example 1

(Preparing the Pigment Particulate Dispersion Solution)

According to the method below, the pigment particulate dispersion solution that is an aqueous dispersion solution including the pigment particulates was prepared using a pigment as the colorant.

Using a forced thin film reactor ("ULREA SS-11" manufactured by M TECHNIQUE Co., Ltd.) as the microreactor, the pigment particulate dispersion solution was prepared by acid pasting method. As the first pigment stock solution, a cyan pigment (C.I. pigment blue 15:3 (copper phthalocyanine)) is dissolved in concentrated sulfuric acid (98%), to obtain a 3% copper phthalocyanine pigment/98% concentrated sulfuric acid aqueous solution.

The device conditions of the microreactor were set as below. As the second pigment stock solution, pure water was used. Under the conditions below, the first pigment stock solution was supplied from the first stock solution supply section x, and the second pigment stock solution was supplied from the second stock solution supply section y.

<Device Conditions>

Process supply pressure: 0.3 MPa

Back pressure: 0.02 MPa

Disc rotation rate: 1700 rpm

<Condition of the First Stock Solution Supply Section>

Solution temperature: 5° C.

Flow rate: 400 ml/minute

<Condition of the Second Stock Solution Supply Section>

Flow rate: 3 ml/minute

Next, at the solution ejection section z including a cooling jacket, processing for introducing a hydrophilic group into the surface of the pigment particulates was performed by letting a 6N—NaOH aqueous solution flow into the obtained pigment particulates at a flow rate of 24 ml/minute at a solution temperature of 10° C., and quickly mixing the pigment particulates and the NaOH aqueous solution at a jacket cooling water temperature of 10° C.

The mixture thus obtained was stirred and mixed by a stirrer ("Three-One Motor Type 600G" manufactured by Shinto Scientific Co., Ltd., with a stiffing blade of impeller type), on the conditions: a blade peripheral velocity of 1 m/second, a mixing time of 2 hours, and a jacket temperature of 20° C. By stirring and mixing, in a state where the pigment particulates form a soft aggregate, a wet cake including the pigment particulates was collected by filtration using a membrane filter (mesh diameter: 1 μm) from the mixture. The wet cake including the pigment particulates collected by the filtration and the aqueous solution of 0.5% by mass of sodium dodecyl sulfate were put into CLEARMIX (manufactured by M Technique Co., Ltd.), and the pigment particulates were re-dispersed at a rotation rate of 20000 rpm for 5 minutes, to obtain a pigment particulate dispersion solution (P-1) having a solid content concentration of 20% by mass.

The particle size distribution of the pigment particulates included in the pigment particulate dispersion solution thus obtained was measured using the particle size distribution measuring apparatus ("Microtrac UPA 150" manufactured by Nikkiso Co., Ltd.). A mean volume particle diameter thus measured of the pigment particulates was 22 nm, and the Cv value of the particle size distribution was 13%. In addition, the circularity of the pigment particulates was measured using a TEM image of the pigment particulates. For the circularity measured for 3000 pigment particulates, the average circularity of the pigment particulates was 0.940. It should be noted that the Cv value and the circularity are obtained by the formulae below. The Cv value is a value that indicates a spread of the particle diameter distribution, and means that the smaller the Cv value, the sharper the particle diameter distribution.

$$Cv \text{ value} = 100 \times \text{standard deviation/mean volume particle diameter}$$

$$\text{Circularity} = 4\pi S/L^2 \quad (S\text{: area, } L\text{: peripheral length})$$

Preparation Example 2

(Preparing the Releasing Agent Particulate Dispersion Solution)

According to the method below, the releasing agent particulate dispersion solution that is an aqueous dispersion solution including the releasing agent particulates was prepared. The releasing agent ("Paraffin Wax, HNP-9PD" manufactured by Nippon Seiro Co., Ltd.), 20% by mass of an anionic surfactant ("EMULGEN 0" manufactured by Kao Corporation) with respect to a solid content of the releasing agent, and an amount of ion-exchange water which made the solid content concentration of the releasing agent particulate dispersion solution 20% by mass, were put into Nanomizer (manufactured by YOSHIDA KIKAI CO., LTD.), to be mixed. The mixture thus obtained is sheared and emulsified at 50 MPa at 90° C. for 15 minutes, to obtain the releasing agent particulate dispersion solution.

Examples 1 to 6 and Comparative Examples 1 to 4

According to processes (I) to (VIII) below, the toner was prepared. For the binder resin, the following polyester resins A to D were used.

—Polyester Resin A

Monomer composition: polyoxypropylene(2,2)-2, 2-bis(4-hydroxyphenyl)propane/polyoxyethylene(2,0)-2, 2-bis(4-hydroxyphenyl)propane/fumaric acid/trimellitic acid=25/25/46/4 (mole fraction)

Number average molecular weight (Mn): 2000

Weight average molecular weight (Mw): 4500

Molecular weight distribution (Mw/Mn): 2.25

Softening point (Tm): 80° C.

Glass transition point (Tg): 41° C.

Acid value (AV): 20 mgKOH/g

—Polyester Resin B:

Monomer composition: polyoxypropylene(2,2)-2, 2-bis(4-hydroxyphenyl)propane/polyoxyethylene(2,0)-2, 2-bis(4-hydroxyphenyl)propane/fumaric acid/trimellitic acid=25/25/45/5 (mole fraction)

Number average molecular weight (Mn): 2400

Weight average molecular weight (Mw): 5700

Molecular weight distribution (Mw/Mn): 2.38

Softening point (Tm): 100° C.

Glass transition point (Tg): 59° C.

Acid value (AV): 21 mgKOH/g

—Polyester Resin C:

Monomer composition: polyoxypropylene(2,2)-2, 2-bis(4-hydroxyphenyl)propane/polyoxyethylene(2,0)-2, 2-bis(4-hydroxyphenyl)propane/fumaric acid/trimellitic acid=25/24/45/6 (mole fraction)

Number average molecular weight (Mn): 3500

Weight average molecular weight (Mw): 8300

Molecular weight distribution (Mw/Mn): 2.37

Softening point (Tm): 122° C.

Glass transition point (Tg): 65° C.

Acid value (AV): 22 mgKOH/g

—Polyester Resin D:

Monomer composition: polyoxypropylene(2,2)-2, 2-bis(4-hydroxyphenyl)propane/polyoxyethylene(2,0)-2,22-bis(4-hydroxyphenyl)propane/fumaric acid/trimellitic acid=20/20/50/10 (mole fraction)

Number average molecular weight (Mn): 2400

Weight average molecular weight (Mw): 5700

Molecular weight distribution (Mw/Mn): 2.38

Softening point (Tm): 100° C.

Glass transition point (Tg): 59° C.

Acid value (AV): 40 mgKOH/g

[Process (I)]

According to the method below, the resin molten solution including the binder resin was prepared.

(Process (i))

For the binder resin, polyester resin of the type described in each of Table 1 and Table 2 was used. The binder resin was melted according to the method below. The binder resin was put into a mixer kneader ("HIVIS DISPER MIX-3D-5 type" manufactured by PRIMIX Corporation), and was heated to the temperature as described in each of Tables 1 and 2 while being stirred with the conditions of Planetary Mixer at 20 rpm and Homo Disper at 1200 rpm so as to melt the binder resin.

(Process (ii))

Using a basic compound of the type described in each of Tables 1 and 2, the binder resin in the molten state was neutralized according to the procedure below. For the basic compound, the following basic compounds a to e were used.

Basic compound a: triethylamine

Basic compound b: triethanolamine

Basic compound c: pyridine

Basic compound d: monoethanolamine

Basic compound e: sodium hydroxide

To the binder resin in the molten state that was obtained in the process (i), a ratio (% by mass) as described in each of Tables 1 and 2 of the basic compound was added, and stiffing was further continued with the conditions of Planetary Mixer at 20 rpm and Homo Disper at 1200 rpm. Next, after adding the basic compound, the stirring was continued until a torque value of the planetary mixer became stable, to obtain the resin molten solution including the binder resin. Tables 1 and 2 show a period of time for which the stirring was continued (neutralization treatment time) after the basic compound was added.

(Process for Adding the Surfactant)

After the process (ii), the stiffing conditions of the mixer kneader were changed to: Planetary Mixer at 40 rpm and Homo Disper at 1200 rpm, and the temperature of the resin molten solution was decreased until the electric current flowing in Planetary Mixer in the mixer kneader became 3.5 A or more. Tables 1 and 2 each show the temperature of the resin molten solution at this time. After decreasing the temperature of the resin molten solution to the temperature described in each of Tables 1 and 2, 5% by mass of an anionic surfactant ("Emal 0" manufactured by Kao Corporation) with respect to the solid content of the binder resin was added to the resin molten solution at the same temperature. After adding the surfactant, the resin molten solution was continuously stirred for 10 minutes.

[Process (II)]

After the process (I), the stirring conditions of the mixer kneader was set to 70 rpm with Planetary Mixer and 2000 rpm with Homo Disper. To the resin molten solution prepared in the process (I), water of 95° C. was added so that the concentration of the binder resin in the solution after adding the water became 10% by mass, to prepare the oil-in-water emulsion containing particulates including the binder resin, as an oil phase. It should be noted that in the process (II) in each of Comparative Examples 1 and 3, it was recognized that a water part and particulates contained as the oil phase and including the binder resin were separated, and the oil-in-water emulsion was not obtained. Therefore, with Comparative Examples 1 and 3, the following operation was not performed.

The mean volume particle diameter of the particulates contained in the obtained oil-in-water emulsion and including the binder resin was measured using a particle diameter measurement apparatus ("LA-950V2" manufactured by HORIBA, Ltd.). Tables 1 and 2 each show the result of the measurement of the mean volume particle diameter of the particulates contained in the oil-in-water emulsion and including the binder resin.

[Process (III)]

Into a 500-mL round-bottom flask made of stainless steel, 85 g of the oil-in-water emulsion obtained in the process (II), 2.5 g of the pigment particulates dispersion solution obtained in Preparation Example 1, and 10 g of the releasing agent particulate dispersion solution obtained in Preparation Example 2 were put and mixed at 25° C.

[Process (IV)]

While stirring the inside of the flask at a rate of 200 rpm by using a stirring blade (Maxblend impeller (prototype)), 3.5 g of magnesium chloride hexahydrate aqueous solution having a concentration of 50% by mass was added into the flask for 5 minutes as an aggregating agent. After adding the aggregating agent, the temperature in the flask was increased to 65° C. at a heating rate of 0.2° C./min. In the process, the aggregated particles were formed at an appropriate aggregation rate while suppressing the aggregation rate of the particulates by adding 10% by mass of an anionic surfactant ("Emal 0" manufactured by Kao Corporation) with respect to the amount of the binder resin into the flask.

[Process (V)]

By stirring the dispersion solution of the aggregated particles thus obtained at a rate of 200 rpm for 2 hours with a temperature in the flask at 65° C., the aggregated particles were coalesced, thus controlling the shape of the aggregated particles in a spherical shape. Subsequently, the temperature in the flask was decreased to 25° C. at a rate of 10° C./minute. A toner base particle dispersion solution including, as toner base particles, the particles having a controlled shape was obtained. The mean volume particle diameter and the sphericity of the toner base particles included in the obtained toner base particle dispersion solution in the flask were measured using the particle size distribution measuring apparatus ("Microtrac UPA 150" manufactured by Nikkiso Co., Ltd.). Tables 1 and 2 each show the result of the measurement of the mean volume particle diameter and sphericity of the toner base particles.

[Process (VI): Washing Process]

From the toner base particle dispersion solution, a wet cake including toner base particles was collected by suction filtration. The collected wet cake was re-dispersed in the ion-exchange water, so as to wash the toner base particles. At the time of dispersing 10 g of the toner base particles in 100 g of the ion-exchange water, until an electric conductivity of the dispersion solution became 3.0 μS/cm or less, the same washing using ion-exchange water was repeatedly performed on the toner base particles. After the electric conductivity of the dispersion solution became 3.0 μS/cm or less, a wet cake of the toner base particles was collected by suction filtration. Subsequently, the collected wet cake of the toner base particles was dried. It should be noted that the amount of the ion-exchange water used for washing the toner base particles was 250 mL with respect to 10 g of the toner base particles. In addition, the electric conductivity of the dispersion solution was measured using an electric conductivity meter ("ES-51" manufactured by HORIBA, Ltd.).

[Process (VII): Drying Process]

The wet cake of the toner base particles was dispersed in a 50%-by-mass density of an ethanol aqueous solution, to obtain a slurry. The slurry thus obtained is dried using a continuous surface-modifying apparatus ("COATMIZER" manufactured by Freund Corporation), to obtain toner base particles. The condition for drying in the case of using the continuous surface-modifying apparatus ("COATMIZER" manufactured by Freund Corporation) was: a hot blast temperature at 45° C. and a blower air volume of 2 $m^3$/min The mean volume particle diameter (MV), the sphericity, and the particle diameter distribution (MV/MN value) of the toner base particles obtained as described above were measured using the particle size distribution measuring apparatus ("Microtrac UPA 150" manufactured by Nikkiso Co., Ltd.). Tables 1 and 2 show results of the measurement of the mean volume particle diameter (MV), the sphericity, and the particle diameter distribution (MV/MN value).

[Process (VIII): External Addition Process]

Using a 5 L-Henschel mixer (manufactured by Mitsui Miike Machinery Co., Ltd.), 20 parts by mass of the toner base particles and 0.4 parts by mass of the external additive ("90G" manufactured by Nippon Aerosil Co., Ltd., which is silica having a primary particle diameter of 20 nm and surface-treated with silicone oil and aminosilane) were mixed for 5 minutes, to attach the external additive to the toner base particles. Subsequently, the toner was classified using a sieve of 300 mesh (with an opening of 48 μm).

<<Checking Image Formation>>

The toner obtained by the method for manufacturing the toner in each of Examples 1 to 6 and Comparative Examples 2 and 4 was used as the two component developer prepared in Preparation Example 3 below, and image formation was performed. Using an image forming apparatus ("FS-05100", a printer manufactured by Kyocera Document Solutions Ltd.), a developing device was filled with the two component developer, and the toner container in the printer was also filled with toner, and image formation was performed. In the case of using the toner obtained in each of Examples 1 to 6, it was possible to recognize that an image of a desired quality was formed. On the other hand, in the case of using the toner obtained in each of Comparative Examples 2 and 4, an image of a desired quality was not formed. This is considered to be because: the particle diameter of the particulates of the binder resin obtained in the process (II) was too large, which did not allow sufficient introduction of the particulates of the releasing agent and the particulates of the pigment into the binder resin when forming the aggregated particles in the process (IV).

Preparation Example 3

The two component developer was prepared by mixing a ferrite carrier coated with fluoridated silicone resin (having an average particle diameter of 35 μm) and 10% by mass of the toner with respect to the mass of the ferrite carrier for 30 minutes, using a mixer (for example, a polyethylene bottle mixer).

TABLE 1

| Example | 1 | 2 | 3 | 4 | 5 | 6 |
|---|---|---|---|---|---|---|
| Polyester resin | | | | | | |
| Type | A | A | A | B | C | B |
| Glass transition point (Tg)[° C.] | 41 | 41 | 41 | 59 | 65 | 59 |
| Softening point (Tm)[° C.] | 80 | 80 | 80 | 100 | 122 | 100 |
| Acid value [mgKOH/g] | 20 | 20 | 20 | 21 | 22 | 21 |
| Process (I) Process (i) [Process for melting binder resin] | | | | | | |
| Heating temperature [° C.] | 110 | 110 | 110 | 130 | 140 | 130 |
| Process (ii) [Process for neutralizing binder resin] Basic compound | | | | | | |
| Type | a | b | c | b | d | b |
| Amount of use [% by mass] | 6 | 6 | 6 | 6 | 6 | 15 |
| Degree of neutralization of binder resin [%] | 166 | 113 | 213 | 113 | 276 | 269 |
| Stirring (neutralization treatment) Time [minute] | 10 | 10 | 10 | 10 | 20 | 5 |
| Heating temperature after process (ii) Process (II) | 90 | 95 | 95 | 105 | 110 | 90 |
| Binder resin particulates Mean volume particle diameter [nm] Process (V) Toner base particles | 132 | 151 | 145 | 162 | 140 | 148 |
| Mean volume particle diameter [μm] | 5.7 | 5.6 | 5.7 | 5.9 | 5.5 | 5.9 |
| Sphericity Process (VII) Toner base particles | 0.960 | 0.971 | 0.964 | 0.965 | 0.970 | 0.960 |
| Mean volume particle diameter (MV)[μm] | 5.7 | 5.5 | 5.6 | 6.0 | 5.5 | 6.0 |
| Sphericity | 0.965 | 0.970 | 0.962 | 0.962 | 0.965 | 0.959 |
| Particle diameter distribution (MV/MN) | 1.2 | 1.2 | 1.2 | 1.2 | 1.2 | 1.2 |

TABLE 2

| | Comparative example | | | |
|---|---|---|---|---|
| | 1 | 2 | 3 | 4 |
| Polyester resin | | | | |
| Type | B | B | A | D |
| Glass transition point (Tg) [° C.] | 59 | 59 | 41 | 59 |
| Softening point (Tm) [° C.] | 100 | 100 | 80 | 100 |
| Acid value [mgKOH/g] | 21 | 21 | 20 | 40 |
| Process (I) Process (i) [Process for melting binder resin] | | | | |
| Heating temperature [° C.] | 130 | 130 | 110 | 130 |
| Process (ii) [Process for neutralizing binder resin] Basic compound | | | | |
| Type | e | b | c | a |
| Amount of use [% by mass] | 6 | 2 | 3 | 6 |
| Degree of neutralization of binder resin [%] | 401 | 63 | 106 | 83 |
| Stirring (neutralization treatment) Time [minute] | 10 | 30 | 10 | 20 |
| Heating temperature after process (ii) Process (II) | 125 | 125 | 110 | 120 |
| Binder resin particulates Mean volume particle diameter [nm] Process (V) Toner base particles | — | 1002 | — | 701 |
| Mean volume particle diameter [μm] | — | 6.0 | — | 5.8 |

TABLE 2-continued

| | Comparative example | | | |
|---|---|---|---|---|
| | 1 | 2 | 3 | 4 |
| Sphericity | — | 0.969 | — | 0.967 |
| Process (VII) | | | | |
| Toner base particles | | | | |
| Mean volume particle diameter (MV)[μm] | — | 6.0 | — | 5.7 |
| Sphericity | — | 0.965 | — | 0.965 |
| Particle diameter distribution (MV/MN) | — | 1.2 | — | 1.2 |

From Tables 1 and 2, it is shown that: by manufacturing the toner using the method which includes processes (I) to (V) as described above and in which the binder resin is polyester resin, the amount of use of the organic base is 6 parts by mass or more with respect to 100 parts by mass of the binder resin, the degree of neutralization of the binder resin in the molten state in process (I) is 100% or more, it is possible to manufacture the toner while neutralizing the binder resin at low temperature and in a short time, thus allowing reduction in the amount of consumption of thermal energy at the time of manufacturing the toner.

What is claimed is:

1. A method for manufacturing an electrostatic latent image developing toner, comprising:

(I) obtaining a resin molten solution including a binder resin by mixing an organic base in a liquid state and the binder resin in a molten state for neutralizing the binder resin;

(II) obtaining an oil-in-water emulsion by mixing the resin molten solution with water, the oil-in-water emulsion containing, as an oil phase, particulates including the binder resin;

(III) obtaining a particulate mixture dispersion solution by mixing the oil-in-water emulsion with an aqueous dispersion solution including colorant particulates, an aqueous dispersion solution including releasing agent particulates, or an aqueous dispersion solution including the colorant particulates and the releasing agent particulates;

(IV) forming aggregated particles by adding an aggregating agent to the particulate mixture dispersion solution for aggregating the particulates in the particulate mixture dispersion solution; and (V) coalescing components included in the aggregated particles by maintaining the aggregated particles at a temperature within a range that is higher than a glass transition point (Tg) of the binder resin by 10° C. and is lower than a softening point (Tm) of the binder resin, wherein the binder resin is polyester resin, an amount of use of the organic base is 6 parts by mass or more with respect to 100 parts by mass of the binder resin, a degree of neutralization of the binder resin in (I) is 100% or more, and the obtaining a resin molten solution in (I) includes:

(i) obtaining a molten solution including the binder resin by heating the binder resin to a temperature higher than the softening point (Tm) of the binder resin and melting the binder resin; and (ii) obtaining the resin molten solution including a neutralized binder resin by mixing the molten solution with the organic base while maintaining the resin molten solution at a temperature higher than a softening point (Tm) of the molten solution.

2. A method for manufacturing an electrostatic latent image developing toner according to claim 1, wherein the organic base is of one or more types selected from a group consisting of: N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, and vinylpyridine.

3. A method for manufacturing an electrostatic latent image developing toner according to claim 1, wherein an average particle diameter of the binder resin particulates is 200 nm or less.

4. A method for manufacturing an electrostatic latent image developing toner according to claim 1, wherein the degree of neutralization of the binder resin in (I) is 300% or less.

5. A method for manufacturing an electrostatic latent image developing toner according to claim 1, wherein the molten solution is obtained in (i) by heating the binder resin from room temperature to the temperature higher than the softening point (Tm) of the binder resin and melting the binder resin.

6. A method for manufacturing an electrostatic latent image developing toner according to claim 1, wherein the resin molten solution after mixing the molten solution with the organic base in (ii) or the oil-in-water emulsion in (II) is mixed with a surfactant.

7. A method for manufacturing an electrostatic latent image developing toner according to claim 1, wherein the resin molten solution after mixing the molten solution with the organic base in (ii) consists of the organic base and the binder resin.

* * * * *